US011491628B2

(12) United States Patent
Liu

(10) Patent No.: US 11,491,628 B2
(45) Date of Patent: Nov. 8, 2022

(54) IMPACT TOOL

(71) Applicant: Chao-Min Liu, Taichung (TW)

(72) Inventor: Lai-Cheng Liu, Taichung (TW)

(73) Assignee: Chao-Min Liu, Taichung (TW)

( * ) Notice: Subject to any disclaimer, the term of this patent is extended or adjusted under 35 U.S.C. 154(b) by 534 days.

(21) Appl. No.: 16/662,568

(22) Filed: Oct. 24, 2019

(65) Prior Publication Data

US 2020/0306944 A1 Oct. 1, 2020

(30) Foreign Application Priority Data

Mar. 26, 2019 (TW) ..... 108110548

(51) Int. Cl.
*B25D 1/12* (2006.01)
*B25D 1/02* (2006.01)

(52) U.S. Cl.
CPC ..... *B25D 1/12* (2013.01); *B25D 1/02* (2013.01); *B25D 2222/57* (2013.01)

(58) Field of Classification Search
None
See application file for complete search history.

(56) References Cited

U.S. PATENT DOCUMENTS 5,259,274 A * 11/1993 Hreha ..... B25G 3/34 81/22
2014/0213706 A1* 7/2014 Honda ..... C08K 3/04 524/186
2017/0275894 A1* 9/2017 Jacober ..... E04F 21/22
2017/0275895 A1* 9/2017 Jacober ..... E04F 15/02038

FOREIGN PATENT DOCUMENTS

CN 207522529 * 6/2018
JP 2020006491 A * 1/2020
TW M315144 U 7/2007

OTHER PUBLICATIONS

Trans of JP 2020006491 (Year: 2020).*
Trans of CN 207522529 (Year: 2018).*

* cited by examiner

*Primary Examiner* — Brian D Keller
(74) *Attorney, Agent, or Firm* — Muncy, Geissler, Olds & Lowe, P.C.

(57) ABSTRACT

An impact tool is provided, including a working portion and a handle. The working portion includes a housing which is made of rubber and a filler. The housing defines an inner space, and the filler is stuffed with the inner space. The filler is shear thickening non-Newtonian fluid. The handle is connected with the working potion.

7 Claims, 9 Drawing Sheets

IMPACT TOOL

BACKGROUND OF THE INVENTION

Field of the Invention

The present invention relates to an impact tool.

Description of the Prior Art

A hammer is usually used to strike an object to assemble or embed the object be assembled or embedded. A hammer having a rubber impact surface can avoid damage to appearance or structure of the object such as decking boards, sheet metal, furniture or delicate structures, etc. The conventional hammer having the rubber impact surface, such as the impact tool disclosed in TWM315144, is made by cladding a rubber layer directly on a hammer head or assembling a rubber head on the hammer head.

In the conventional hammer as described above, an internal structure of the hammer head is made of hard material to provide impact force, and the rubber impact surface is configured to protect the object to be impacted. However, the impact force exerted during impacting is transmitted to an operator's hand through the internal structure of the hammer head, which may result in injury to the operator.

For solving the problem as described above, the hammer head is configured to be hollow so as to receive a shock absorption mechanism such as steel balls, iron sand, springs or the like. However, the hammer as described above has a complicated structure, high cost and is inconvenient for assembling and heavy.

The present invention is, therefore, arisen to obviate or at least mitigate the above-mentioned disadvantages.

SUMMARY OF THE INVENTION

The main object of the present invention is to provide an impact tool which can effectively absorb an impact force generated during impacting so as to avoid injury to an operator and has advantages of simple structure and shock absorption.

To achieve the above and other objects, the present invention provides an impact tool, including a working portion and a handle. The working portion includes a housing which is made of rubber and a filler. The housing defines an inner space, and the filler is stuffed with the inner space. The filler is shear thickening non-Newtonian fluid. The handle is connected with the working portion.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
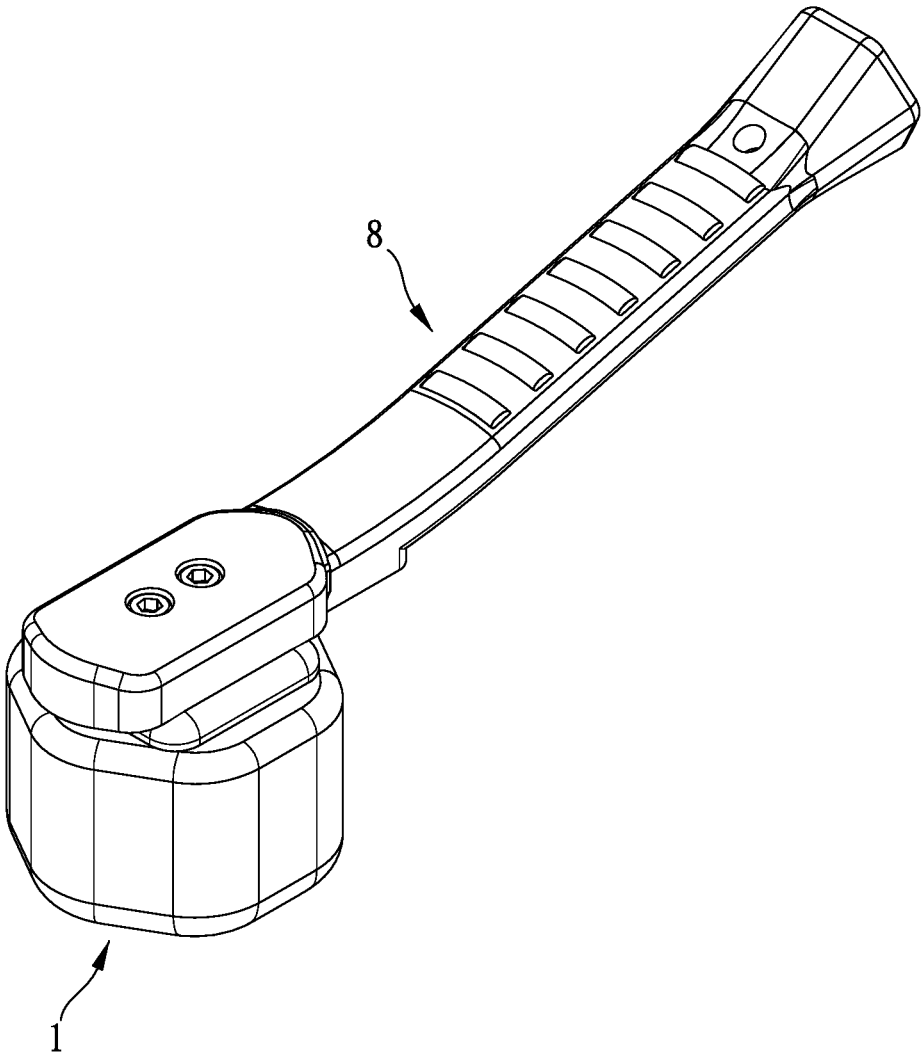
FIG. 1 is a stereogram of a preferable embodiment of the present invention.
Figure 2:
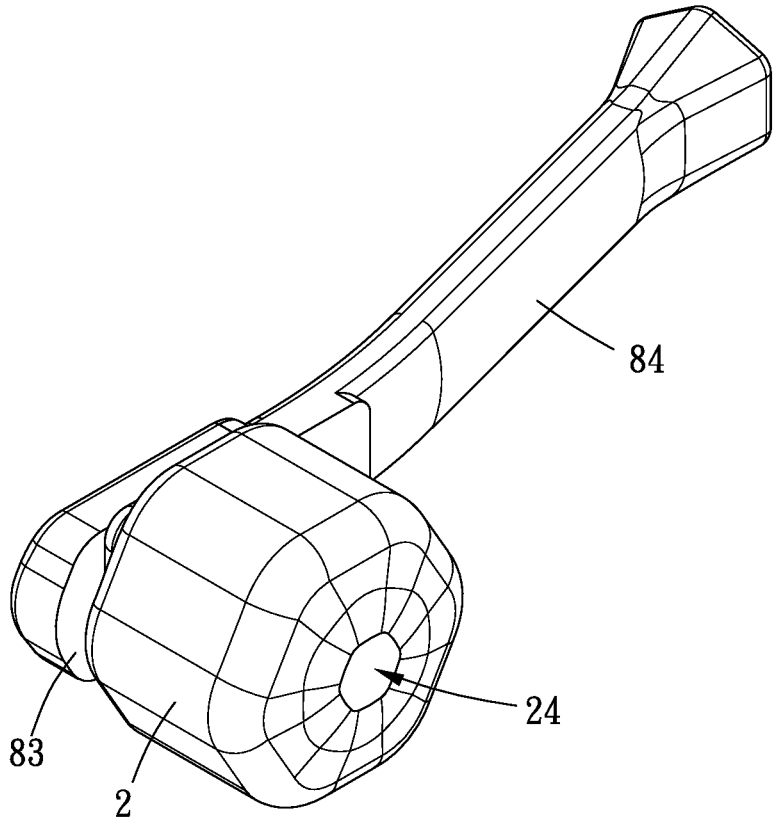
FIG. 2 is another stereogram as viewed from another side according to a preferable embodiment of the present invention.
Figure 3:
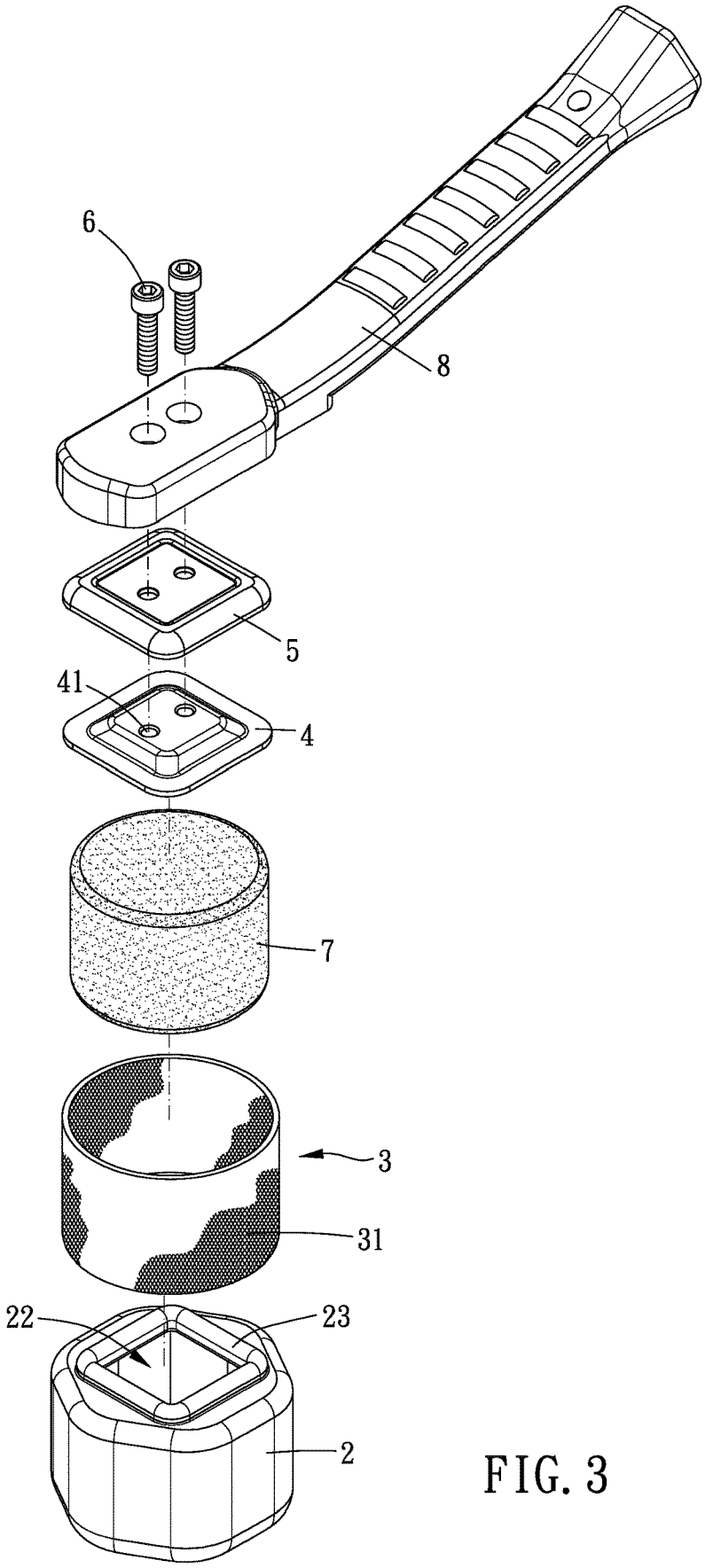
FIG. 3 is a breakdown drawing of a preferable embodiment of the present invention.
Figure 4:
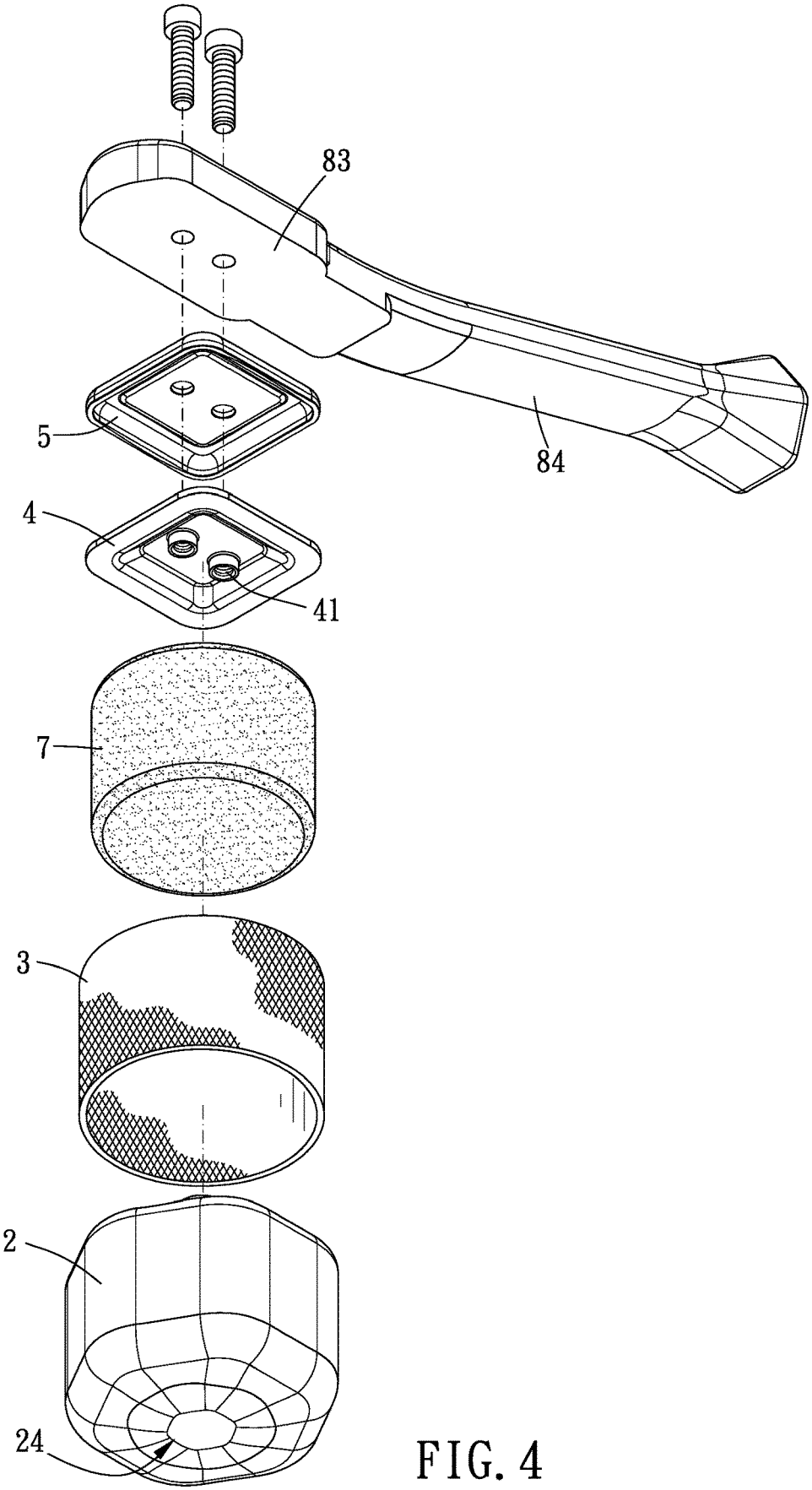
FIG. 4 is another breakdown drawing as viewed from another side according to a preferable embodiment of the present invention.
Figure 5:
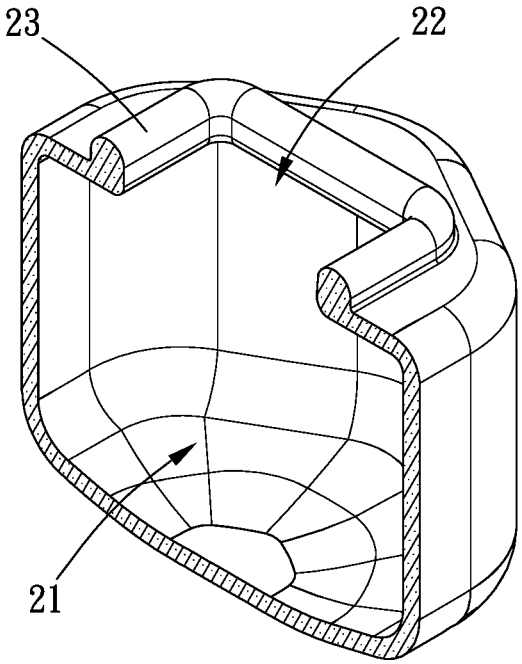
FIG. 5 is a partial cross-sectional view of a housing of a preferable embodiment of the present invention.
Figures 6, 7:
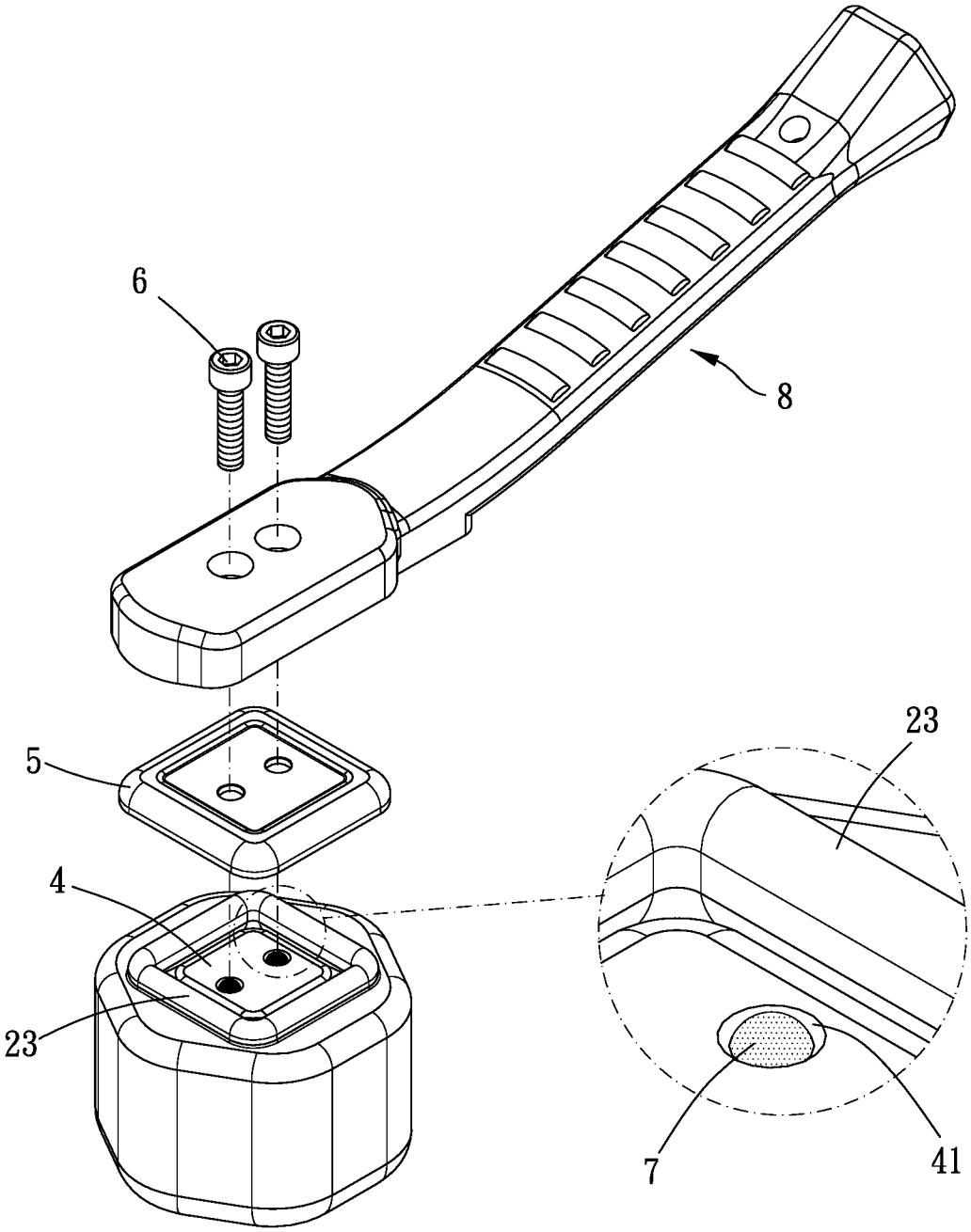
FIG. 6 is a breakdown drawing of a handle and a working portion of a preferable embodiment of the present invention.
FIG. 7 is a partial enlargement of FIG. 6.
Figure 8:
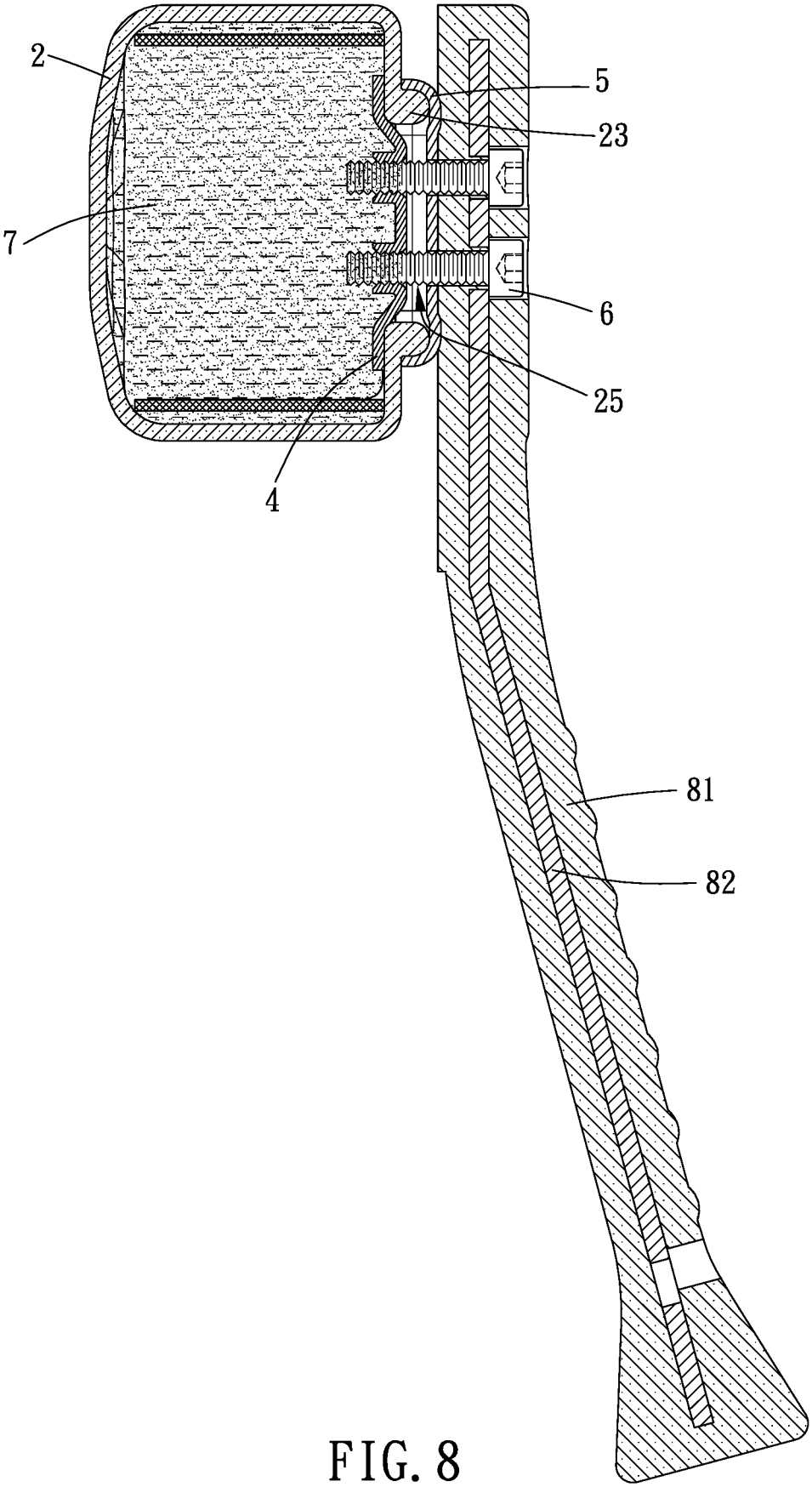
FIG. 8 is a cross-sectional view of FIG. 1.
Figure 9:
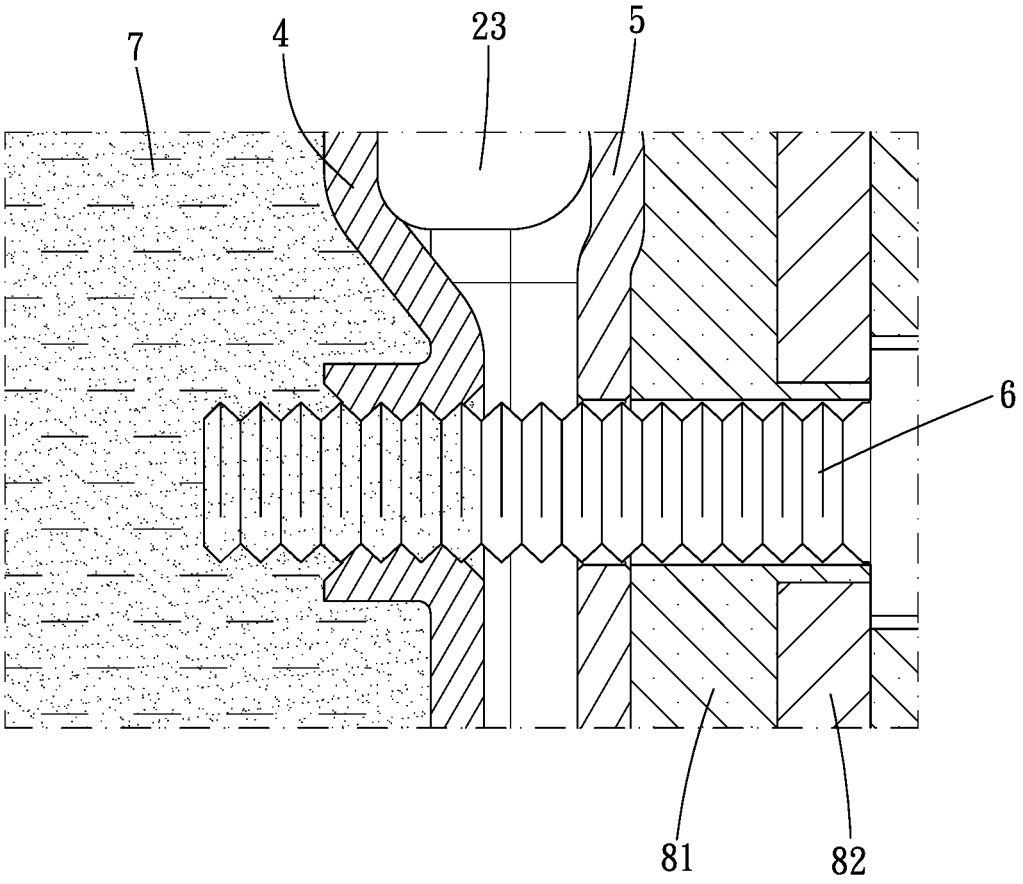
FIG. 9 is a partial enlargement of FIG. 8.
Figure 10:
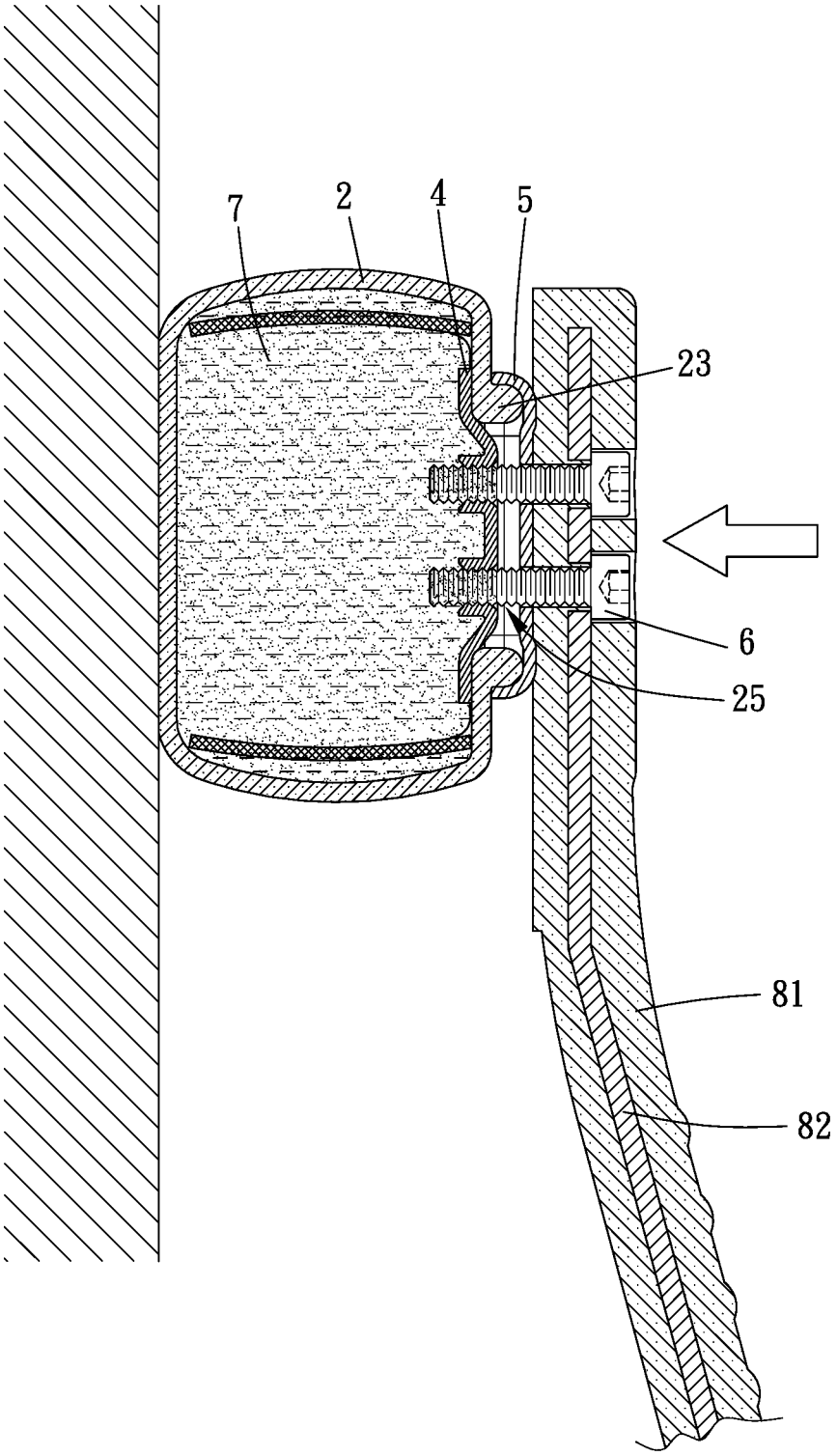
FIG. 10 is a cross-sectional view of a preferable embodiment of the present invention during impacting.

Please refer to FIGS. 1 to 10 for a preferable embodiment of the present invention. An impact tool of the present invention includes a working portion 1 and a handle 8.

The working portion 1 includes a housing 2 which is made of rubber and a filler 7 so that the housing 2 can protect an appearance of an object to be impacted (such as decking boards sheet metal, furniture and delicate structures, etc.) and reduce noise. The housing 2 defines an inner space 21, and the filler 7 is stuffed with the inner space 21. The filler 7 is shear thickening non-Newtonian fluid so that the filler 7 becomes sticky, hard and has low resilience characteristic as being impacted so as to effectively absorb the impact force generated by impacting and avoid injury to an operator.

In this embodiment, the filler 7 may be an unvulcanized synthetic rubber body which is a material in a rubber-related filed so that the filler 7 is less likely to have unexpected chemical reaction with the housing 2, and the filler 7 does not rub against or puncture the housing 2, which maintains integrity of the housing 2 for long-term use.

Preferably, the working portion 1 further includes at least one supporting member 3 received in the inner space 21 so that the working portion 1 has sufficient hardness. In this embodiment, the at least one supporting member 3 includes one of said supporting member 3 having a plurality of through holes 31, and the filler 7 is flowable through the plurality of through holes 31 when the working portion 1 is impacted, and the working portion 1 is locally deformed according to a direction of the impact force so as to disperse the impact force.

The supporting member 3 is annular and disposed around the filler 7. During impacting, the impact force is transmitted substantially along an axial direction of the supporting member 3, and the supporting member 3 being annular can retard the filler 7 to flow radially so that the filler 7 is not easy to radially spread out quickly and a sufficient amount of the filler 7 can be maintained for impacting the object to be impacted. The supporting member 3 is preferably made of polypropylene (PP) net which has preferable impact resistance, corrosion resistance, heat resistance, toughness, elasticity, and high chemical stability, so that the filler 7 and the supporting member 3 will not chemically react.

The housing 2 further includes an opening 22 communicated with the inner space 21, and a base 4 is received in the inner space 21 and disposed between the filler 7 and the opening 22. The base 4 is abutted against the housing 2, and the handle 8 covers the opening 22 and is connected with the base 4 so as to connect the handle 8 with the working portion 1. In this embodiment, the base 4 covers the filler 7 in an opening direction of the opening 22.

Preferably, part of the base 4 protrudes into the opening 22, and the base 4 is abutted against the housing 2 in the opening direction of the opening 22 so as to stably position the base 4 to the housing 2.

Specifically, the base 4 includes at least one assembling hole 41 disposed therethrough, part of the filler 7 is disposed within the assembling hole 41, and at least one connecting member 6 is disposed through the handle 8 and connected with the at least one assembling hole 41. The at least one connecting member 6 is disposed within the filler 7. In other words, the filler 7 can fill gaps between the at least one connecting member 6 and the at least one assembling hole 41 so that the inner space 21 approaches to an airtight space and the filler 7 is less susceptible to oxidizaton and deterioration. Moreover, the filler 7 is viscous, which enhances combination of the at least one connecting member 6 and the at least one assembling hole 41.

In this embodiment, the at least one assembling hole 41 is a threaded hole, and the at least one connecting member 6 is a screw. The at least one assembling hole 41 includes two said assembling holes 41, two said connecting members 6 are arranged symmetrically at two opposite sides of a center of the opening 22, and a wall of the at least one assembling hole 41 extends into the filler 7.

Specifically, the housing 2 further includes a flange 23 disposed around the opening 22, and a cover 5 covers the opening 22 and receives the flange 23. At least one connecting member 6 is disposed through the handle 8 and the cover 5 is connected with the base 4; the flange 23 is clamped between the base 4 and the cover 5, which is not easy to detach due to external force. In other embodiments, the cover may be formed as a part of the handle.

In this embodiment, the cover 5 and the base 4 is made of metal so as to stably clamp the flange 23. Contours of the base 4, the cover 5 and the opening 22 are square to avoid rotation relative to one another. The contour of the opening 22 has a smallest diametrical dimension relative to the contours of the base 4 and the cover 5, and a diametrical dimension of the contour of the base 4 is equal to a diametrical dimension of the contour of the cover 5.

Preferably, the base 4 and the cover 5 are spaced apart from each other, and the base 4, the flange 23 and the cover 5 define a space 25 therebetween. Therefore, the base 4 and the flange 23 are slightly deformable or movable with the filler 7 during impacting, and the space 25 can prevent the base 4 and the cover 5 from colliding or abrading with each other.

The handle 8 includes a coating 81 and a main body 82, the main body 82 is an elongate plate and harder than the coating 81, and the coating 81 encompasses the main body 82. The main body 82 has relatively high hardness and good force transmitting effect, and the coating 81 is relatively soft and comfortable for gripping. In an exemplary embodiment, the main body 82 is made of metal, and the coating 81 is made of rubber.

The handle 8 includes an assembling segment 83 and a holding segment 84, and the working portion 1 is positioned on the assembling segment 83. The holding segment 84 is tilted to the assembling segment 83, and an angle between the assembling segment 83 and the holding segment 84 is between 10 and 30 degrees.

Moreover, the holding segment 84 extends in a direction away from the working portion 1 (upwardly) so as to generate a force in a direction toward the working portion 1 (downwardly) when the holding segment 84 is gripped, which is convenient to operate the impact tool. Specifically, the assembling segment 83 extends straightly, and in an extending direction of the assembling segment 83, a side of the working portion 1 remote from the holding segment 84 is preferably flush with the assembling segment 83 so as to avoid unexpected interference.

As viewed in the opening direction of the opening 22, an end of the assembling segment 83 remote from the holding segment 84 has a contour partially overlapped with a contour of the working portion 1, and in the extending direction of the assembling segment 83, a ratio of a length of the working portion 1 to a length of the assembling segment 83 is between 0.6 and 0.8 so as to have preferable impacting effect. An impact surface 24 of the housing 2 preferably has a contour which is the same with a contour of an end surface of the handle 8. Therefore, the operator can choose the impact tool with appropriate impact surface 24 by the contour of the end surface of the handle 8. In this embodiment, the housing 2 is a hexagonal column, and the impact surface 24 is hexagonal.

In summary, the impact tool of the present invention is modified in several parts in considering with actual operation to obtain a preferable structure. The working portion includes the housing made of rubber and the filler which is shear thickening non-Newtonian fluid, which is easy to assemble and greatly simplifies the structure of the impact tool. The housing prevents the object to be impacted from being damaged, and the filler can effectively absorb the impact force. The base and the cover which connect the handle with working portion clamp the housing, and the base and the cover are made of metal so as to increase structural strength. Moreover, the handle includes the coating made of rubber to absorb shock and the main body made of metal to increase structural strength and durability.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An impact tool, including:

a working portion, including a housing which is made of rubber and a filler, the housing defining an inner space, the filler being stuffed with the inner space, the filler being a shear thickening non-Newtonian fluid;

a handle, connected with the working portion;

wherein the working portion further includes at least one supporting member received in the inner space;

wherein the working portion includes one of said supporting member having a plurality of through holes, and the filler is flowable through the plurality of through holes.

2. The impact tool of claim 1, wherein the filler is an unvulcanized synthetic rubber body.

3. The impact tool of claim 1, wherein the supporting member is annular and disposed around the filler.

4. The impact tool of claim 1, wherein the handle includes a coating and a main body, the main body is an elongate plate and harder than the coating, and the coating encompasses the main body.

5. The impact tool of claim 1, wherein the filler is an unvulcanized synthetic rubber body; the housing further including an opening communicated with the inner space, a base is received in the inner space and disposed between the filler and the opening, the base is abutted against the housing, and the handle covers the opening and is connected with the base; the base includes at least one assembling hole disposed therethrough, part of the filler is disposed within the at least one assembling hole, at least one connecting member is disposed through the handle and connected with the at least one assembling hole; the at least one connecting member is disposed within the filler; the housing further includes a flange disposed around the opening, a cover covers the opening and receives the flange, at least one connecting member is disposed through the handle and the cover and is connected with the base; the flange is clamped between the base and the cover; the handle includes a coating and a main body, the main body is an elongate plate and harder than the coating, and the coating encompasses the main body; the main body is made of metal, the coating is made of rubber; the handle includes an assembling segment and a holding segment, the working portion is positioned on the assembling segment, the holding segment is tilted to the assembling segment, and an angle between the assembling segment and the holding segment is between 10 and 30 degrees; the assembling segment extends straightly, in an extending direction of the assembling segment, a side of the working portion remote from the holding segment is flush with the assembling segment; as viewed in an opening direction of the opening, an end of the assembling segment remote from the holding segment has a contour partially overlapped with a contour of the working portion; in the extending direction of the assembling segment, a ratio of a length of the working portion to a length of the assembling segment is between 0.6 and 0.8; the supporting member is made of polypropylene (PP) net; the cover and the base are made of metal; the at least one assembling hole is a threaded hole, the at least one connecting member is a screw, the at least one assembling hole includes two said assembling holes, and two said connecting members are arranged symmetrically at two opposite sides of a center of the opening; part of the base protrudes into the opening; an impact surface of the housing has a contour which is the same as a contour of an end surface of the handle; the housing is a hexagonal column, and the impact surface is hexagonal; the base and the cover are spaced apart from each other, and the base, the flange and the cover define a space therebetween; contours of the base, the cover and the opening are square, the contour of the opening has a smallest diametrical dimension relative to the contours of the base and the cover, and a diametrical dimension of the contour of the base is equal to a diametrical dimension of the contour of the cover; a wall of the at least one assembling hole extends into the filler.

6. An impact tool, including:

a working portion, including a housing which is made of rubber and a filler, the housing defining an inner space, the filler being stuffed with the inner space, the filler being a shear thickening non-Newtonian fluid;

a handle, connected with the working portion;

wherein the housing includes an opening communicated with the inner space, a base is received in the inner space and disposed between the filler and the opening, the base is abutted against the housing, and the handle covers the opening and is connected with the base;

wherein the base includes at least one assembling hole disposed therethrough, part of the filler is disposed within the at least one assembling hole, at least one connecting member is disposed through the handle and connected with the at least one assembling hole; the at least one connecting member is disposed within the filler.

7. An impact tool, including:

a working portion, including a housing which is made of rubber and a filler, the housing defining an inner space, the filler being stuffed with the inner space, the filler being a shear thickening non-Newtonian fluid;

a handle, connected with the working portion;

wherein the housing includes an opening communicated with the inner space, a base is received in the inner space and disposed between the filler and the opening, the base is abutted against the housing, and the handle covers the opening and is connected with the base;

wherein the housing includes a flange disposed around the opening, a cover covers the opening and receives the flange, at least one connecting member is disposed through the handle and the cover and is connected with the base; the flange is clamped between the base and the cover.

* * * * *